US005508901A

United States Patent [19]

Kuo

[11] Patent Number: 5,508,901

[45] Date of Patent: Apr. 16, 1996

[54] MULTI-COLORED LIGHT-EMITTING FLOWER DECORATION

[76] Inventor: Ming-Shish Kuo, 170 Ming-Tsu Road Section 2, Tainan, Taiwan

[21] Appl. No.: 406,461

[22] Filed: Mar. 20, 1995

[51] Int. Cl.[6] ..... F21P 1/02

[52] U.S. Cl. ..... 362/122; 362/34; 362/806

[58] Field of Search ..... 362/34, 122, 806

[56] References Cited

U.S. PATENT DOCUMENTS 4,171,754 10/1979 Rosado ..... 362/122
4,215,462 8/1980 Fernandez ..... 362/122
4,789,572 12/1988 Weaver ..... 362/122
4,910,647 3/1990 Gong ..... 362/122
5,063,485 11/1991 Harris ..... 362/122

*Primary Examiner*—Denise L. Gromada
*Assistant Examiner*—Alfred Basichas

[57] ABSTRACT

A multi-colored light-emitting flower decoration comprising a base for containing two chemical tubes filled with different chemical solutions, a cap screwed downward around the case to break the two chemical tubes for mixing the two chemical solutions to give out light, three sucking tubes fitted in three tubes, which are fitted in a guide tube, the sucking tubes sucking the mixed chemical solutions upward to reach flowers fixed on top of the sucking tubes to let the flowers look as if emitting light, a metal strip being inserted in each sucking tubes to reflect light.

2 Claims, 4 Drawing Sheets

MULTI-COLORED LIGHT-EMITTING FLOWER DECORATION

BACKGROUND OF THE INVENTION

This invention concerns a multi-colored light emitting flower decoration, particularly one having two chemicals filled in two tubes to be compressed by a cap screwed downward on a base wherein the two tubes are placed, and then the two tubes are broken to let two different chemical solutions mix with each other to emit light, and the mixed solution is sucked up by sucking tubes to reach flowers fixed on top of each sucking tube to emit light.

So far conventional flowers, decorations, etc. for visual enjoyment have no light-emitting devices to be seen during nighttime, and there must be some light to shine on them if they are to be seen for visual enjoyment during nighttime.

SUMMARY OF THE INVENTION

An object of this invention is to offer a light-emitting flower decoration for visional enjoyment during nighttime.

Another object of this invention is to offer a multi-colored light-emitting flower decoration comprising two chemical solutions to be mixed together for emitting light, and two tubes containing the chemicals are replaceable for repetitive use of the flower decoration itself.

One more object of this invention is to offer a multi-colored light-emitting flower decoration wherein a perfume or a scent producing chemical can be additionally added to give out a comfortable scent in a room where the flower decoration is placed.

The main feature of the present invention is two different chemical solutions contained in two tubes, which are positioned in a few chambers in a base. Then the two chemical tubes are broken by screwing a cap screwed with the base to be mixed together in the chambers for giving out light. Then the mixed chemical solution may be sucked up by sucking tubes respectively having a metal strip to reflect light and a sucking means made of material such as cotton, paper, or cloth to reach the flowers also made of the same material as the sucking means in order to make the flowers emit light.

DETAILED DESCRIPTION OF THE INVENTION

Figure 1:
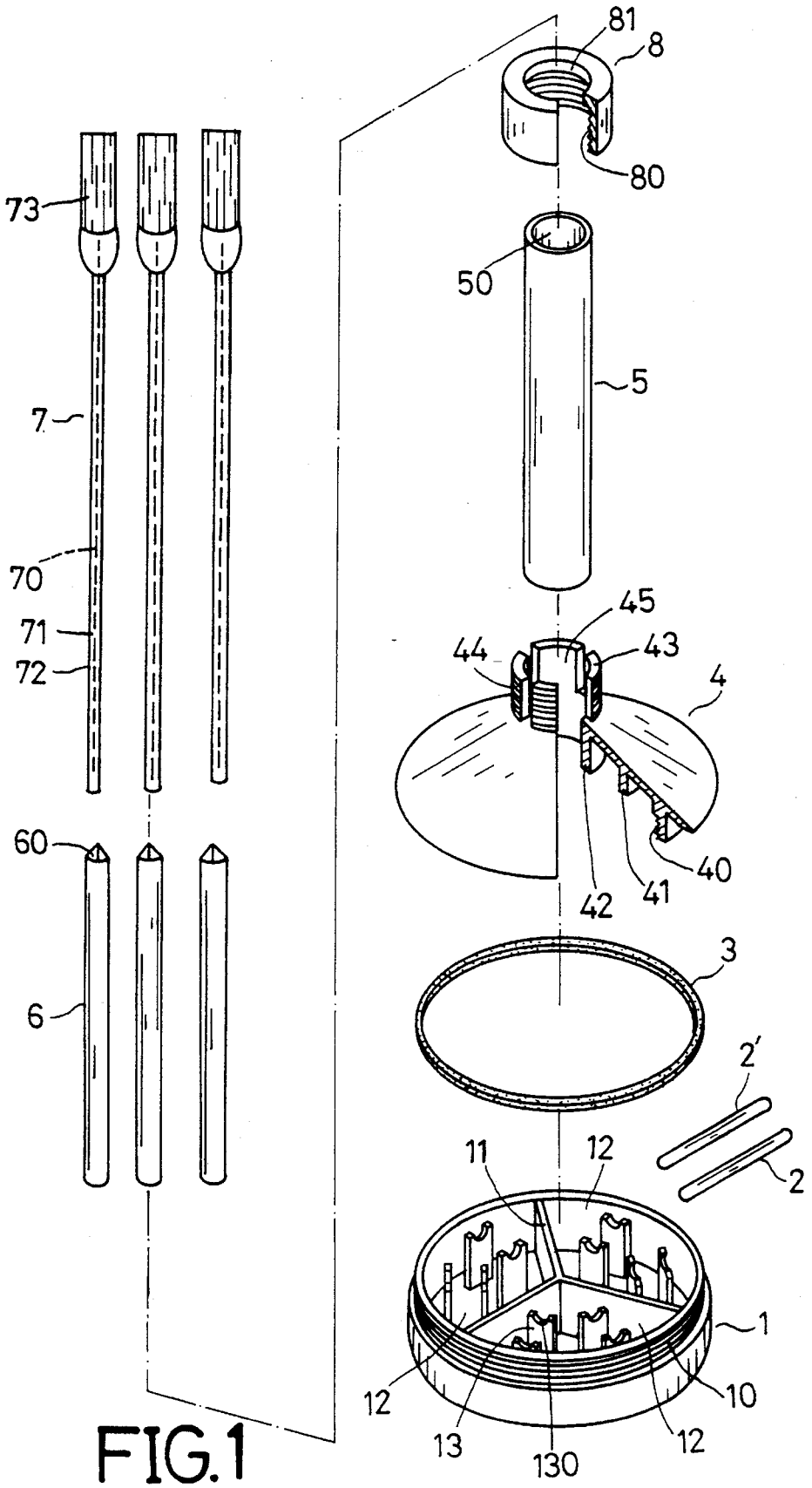
FIG. 1 is an exploded perspective view of a multi-colored light-emitting flower decoration in the present invention.

A multi-colored light-emitting flower decoration in the present invention, as shown in FIG. 1, comprises a base 1, a first chemical tube 2, a second chemical tube 2', a gasket 3, a cap 4, a guide tube 5, three elongate tubes 6, three sucking tubes 7, and an impact collar 8 combined together.

The base 1 is shaped as a round case with an upper opening, a male thread 10 in an upper portion of its annular wall, three separating walls 11 dividing radially its interior equally into three chambers 12 of the same size, two pairs of plate posts 13 properly spaced apart respectively in each of the three chambers 12, each plate post 13 having a U-shaped face on top.

The first and the second chemical tubes 2, 2' are positioned on the plate posts 13 in the three chambers 12, and in processing, a first chemical solution such as oxalic acid is filled in the first chemical tube 2, and a second chemical such as hydrogen peroxide is filled in the second chemical tube 2'. Then in case that the two chemicals are mixed together, a light can be emitted out of the mixed solution.

The gasket 3 made of a soft elastic material is located on the base I to prevent mixed chemical solution from leaking out of the chambers 12 in the base 1.

The cap 4 has a little funnel-shaped portion, a female thread 40 in and outer surface of a large annular wall extending downward to engage with the male thread 10 of the base 1, an annular wall 41 extending downward and being of a smaller size than the large annular wall, a tubular portion 42 of the smallest size, a neck portion 43 on the tubular portion 42 having some resilience and a male thread 44 on its outer surface, and a through hole 45 defined by the neck portion 43 and the tubular portion 42.

The guide tube 5 is located in the through hole 45, having its bottom end extending down to rest on the separating walls 11, and its top extending upward, and a center through hole 50.

The three elongate tubes 6 are fitted in the center through hole 50 of the guide tube 5, colored with different colors on their outer surfaces, such as red, yellow and green, having a center through hole 60 respectively.

The three sucking tubes 7 are fitted through in the elongate tubes 6 respectively, having longer length than the elongate tubes 6, a metal strip 70 respectively inserted therein, a sucking means 71 such as cotton, paper, or cloth surrounding each metal strip 70, a film 72 surrounding each sucking means 71. Each sucking tube 7 has on top a flower 73 made of material having capillary attraction, such as cotton, paper, or cloth.

The collar 8 has an female thread 80 to engage the male thread 44 of the neck 43 of the cap 4 and a center through hole 81 for the three elongate tubes 6 to fit therein.

Figure 2:
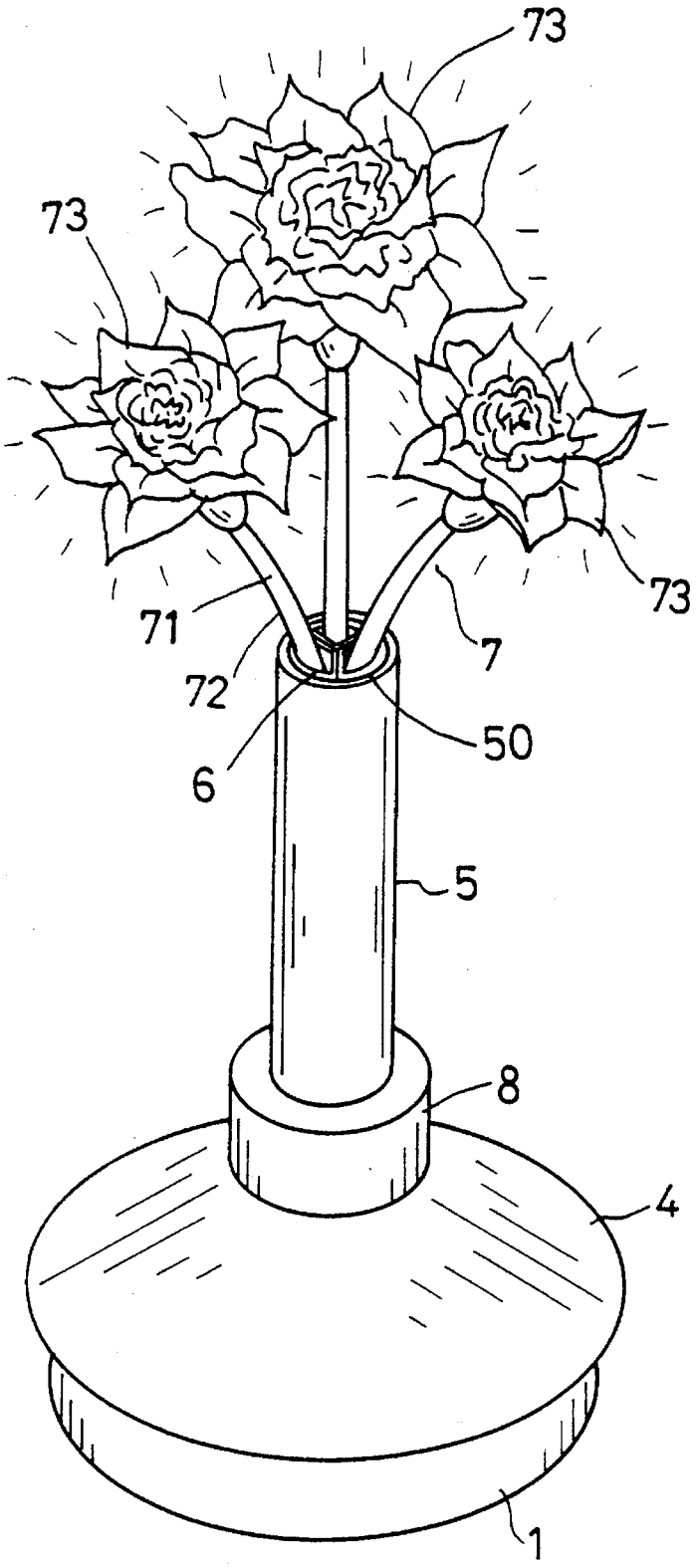
FIG. 2 is a perspective view of the multi-colored light-emitting flower decoration in the present invention.

In assembling, referring to FIG. 1, firstly, the first and the second chemical tubes 2, 2' are placed on the curved faces 130 of the plate posts 13 of the three chambers 12 of the base 1. Next, the gasket 3 is placed on the base 1, and then the three sucking tubes 7 are inserted in the center through holes 60 of the elongate tubes 6, with the flowers 73 on top of the sucking tubes 7 being expanded to become a kind of flower according to user's taste. After that, the three elongate tubes 6 are inserted in the center hole 50 of the guide tube 5, and the guide tube 5 is placed with its bottom end inserted through the through hole 45 of the cap 4 and rested on the three separating walls 11. Then the collar 8 is fitted around the guide tube 5 and pushed down to engage with the male thread 44 of the neck 43 of the cap 4. As the neck portion 43 has resilience to incline inward after engagement of the collar 8 with itself so that the guide tube 5 may be secured upright without swaying to and fro. Lastly, the cap 4 is made to engage with the base 1 tightly, with the female thread 40 engaging the male thread 10, and the bottom ends of the sucking tubes 7 are respectively extend in the three chambers 12 as shown in FIG. 2.

Figure 3:
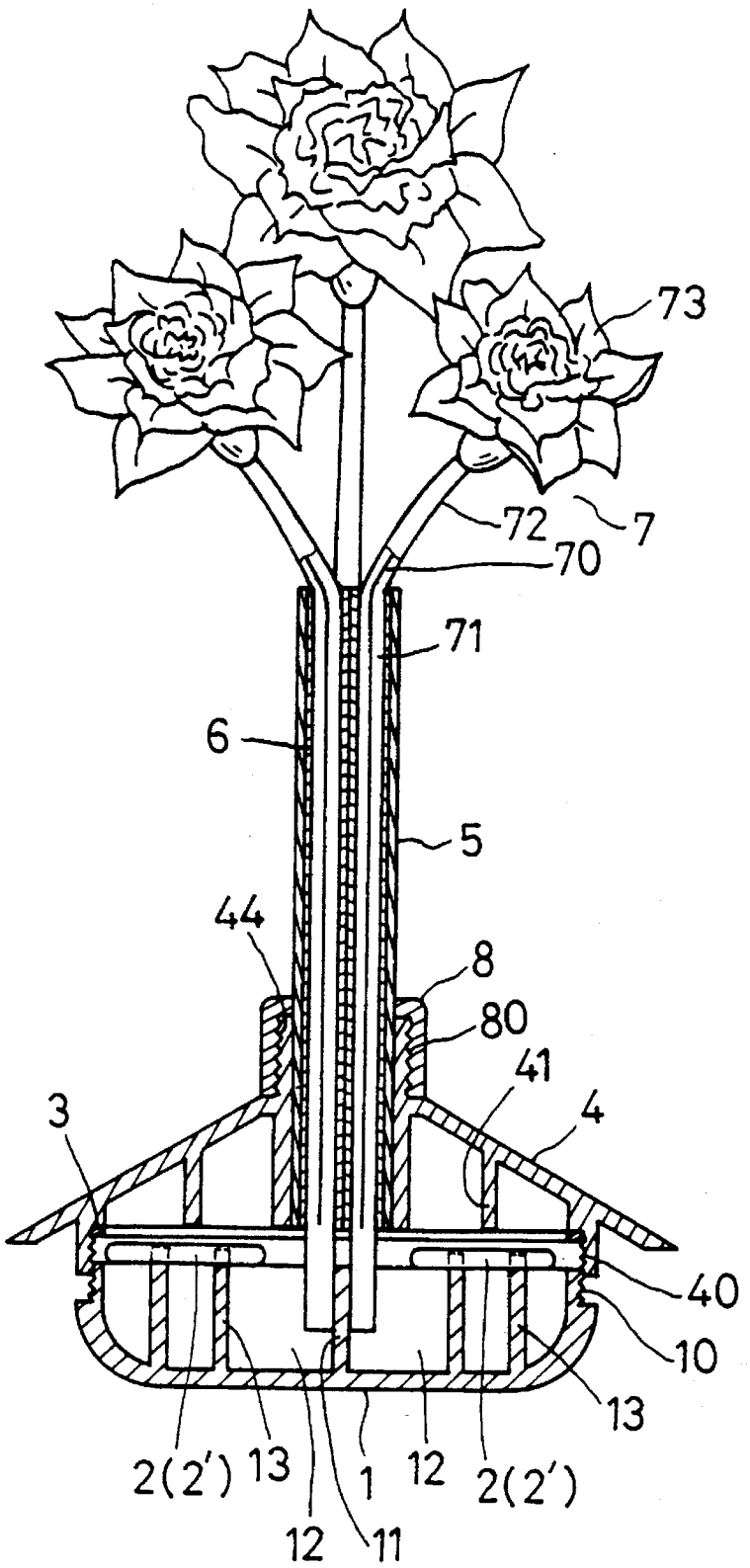
FIG. 3 is a cross-sectional view of the multi-colored light-emitting flower decoration in the present invention, with two chemical solutions not yet mixed together.
Figure 4:
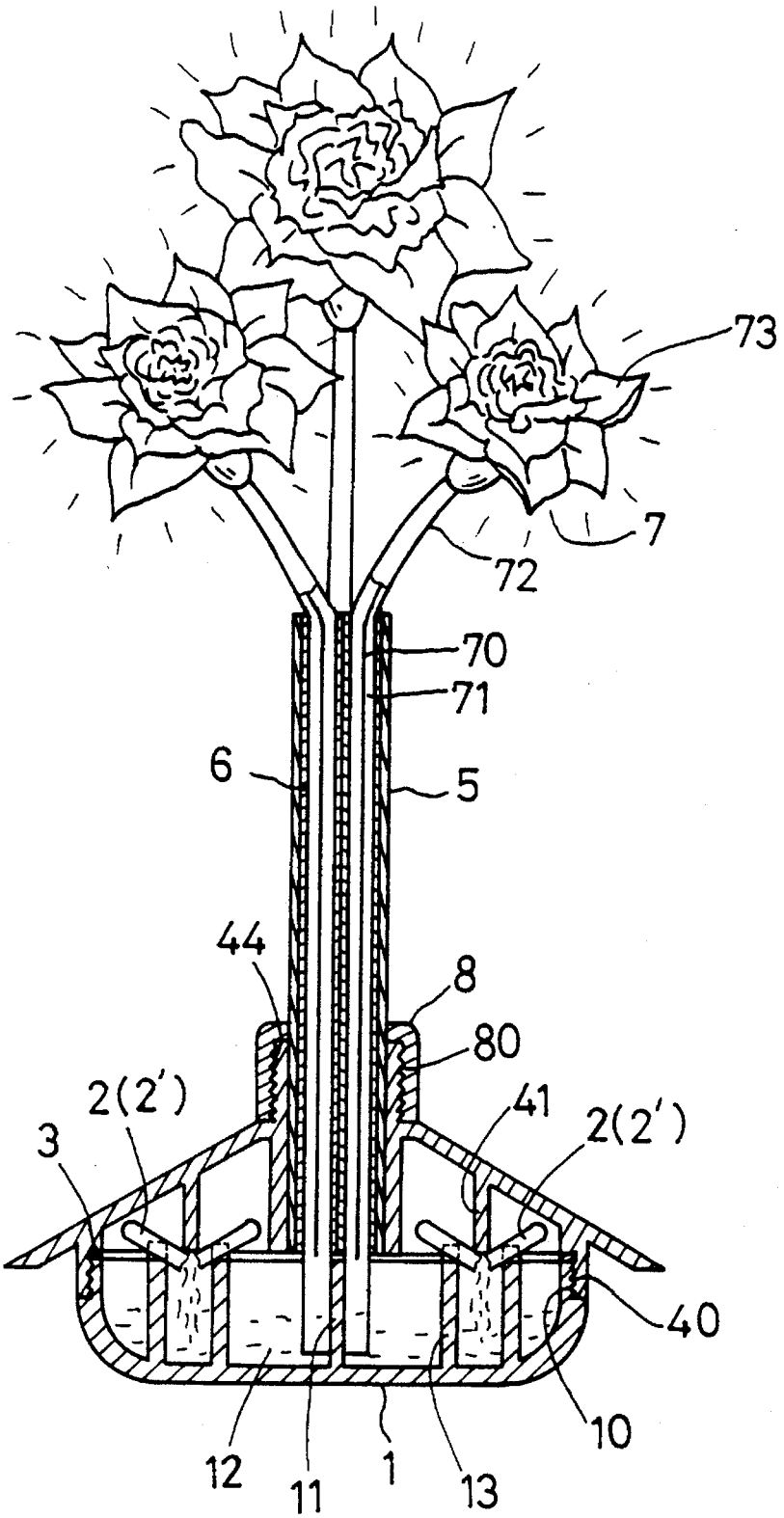
FIG. 4 is a cross-sectional view of the multi-colored light-emitting flower decoration in the present invention, with two chemical solutions mixed together.

In use, referring to FIGS. 3 and 4, after the flower decoration is assembled together, the cap 4 is screwed tightly with the base 1, and at the same time downward pressure produced by the cap 4 causes the two chemical tubes 2, 2' on the plate posts 13 in the chambers 12 to break, with the chemical solutions in the two chemical tubes 2, 2' mixing with each other in the chambers 12 to emit light. The colors of the mixed chemical solutions in the three chambers are different from each other, such as red, yellow, and green, and the sucking means 71 of the sucking tubes 7 suck up the colored mixed chemical solutions upward to the flowers 73 by means of capillary attraction. The metal strips 70 have flexibility to reflect light in various direction, and the flowers 73 may be shaped into various kinds of flowers to suit the user's taste. And the gasket 3 can prevent the chemical solutions in the three chambers 12 from leaking out of the base 1, even if the base 1 should fall down.

A second embodiment of the multi-colored light-emitting flower decoration in the present invention can use a perfume or a fragrant scented chemical in the three chambers, without using the two chemical tubes 2, 2', using the flower decoration as a room scent spreader. Or a perfume or a fragrant scented chemical is additionally filled in the three chambers 12 in the first embodiment, making a multi-colored light-emitting flower decoration with a scent.

As can be understood from the above description, this invention has advantages as follows.

1. It has many different colors, adding beautiful feeling for night visual enjoyment.
2. It can be repeatedly used for a long period of time, by washing the three chambers, replacing the first and the second chemical tubes or a new perfume.
3. Hands may not be polluted by the solution inside the sucking tubes, prevented by the film surrounding the sucking means in case of bending the sucking tubes.
4. The flowers can be replaced to give new impression.
5. A perfume or a fragrant scent can be added in the three chambers to provide a comfortable scent to the air in a room.

What is claimed is:

1. A multi-colored light-emitting flower decoration comprising:

a base shaped as a round case with an upper opening, having a male thread on an outer surface of an annular wall, a plurality of chambers formed in its interior by a plurality of separating walls extending radially from the center to the annular wall, a plurality of pairs of parallel plate posts standing upright on the bottom in each of said chambers each plate post having a U-shaped face on top;

first and second chemical tubes respectively placed on each pair of said plate posts in said chambers of said base, the first chemical tube filled with oxalic acid solution, the second chemical tube filled with hydrogen peroxide;

a gasket made of a soft elastic material and positioned on said base;

a cap having a funnel-shaped portion, a female thread in an inner surface of a large diameter annular wall extending down from the funnel-shaped portion, a smaller diameter annular wall extending down from the funnel-shaped portion, a tubular portion extending down from the funnel-shaped portion, a neck portion formed on said tubular portion and having resilience, said tubular portion and the neck portion defining a through hole, a male thread in an outer surface of said neck portion, said female thread of said large diameter annular wall engaging with said male thread of said base to combine said cap with said base;

a guide tube being positioned to fit through down in said through hole of said cap and resting on said separating walls of said base with its bottom end, having a center through hole;

a plurality of elongate tubes being positioned in said guide tube and respectively colored with a color different from each other;

a plurality of sucking tubes being respectively positioned in said elongate tubes, having longer length than said elongate tubes, a bendable metal strip inserted in each said sucking tube, a sucking means surrounding each said metal strip, a film surrounding each said sucking means, a flower positioned on top of each said sucking tubes;

a collar having a female thread in an inner surface to engage said male thread of said neck portion of said cap, and a center through hole to fit around the outer surface of said guide tube; and said first and said second chemical tube on said plate posts in each said chamber in said base being broken in case that said cap is screwed downward, said chemical solutions in both said first and the second chemical tubes mixing with each other after said two chemical tubes are broken and giving out light, said mixed chemical solution being sucked upward by said sucking means of said sucking tubes through their capillary function to reach said flowers on top of each said sucking tube.

2. The multi-colored light-emitting flower decoration as claimed in claim 1, wherein said sucking means of said sucking tubes and said flowers is further comprised of a material, whereby said material provides a capillary function.

* * * * *